US011337877B2

(12) United States Patent
Azevedo

(10) Patent No.: US 11,337,877 B2
(45) Date of Patent: May 24, 2022

(54) DEVICE FOR APPLYING A TENSILE FORCE TO A HINGED JOINT

(71) Applicant: Max Salvador Azevedo, Lenoir, NC (US)

(72) Inventor: Max Salvador Azevedo, Lenoir, NC (US)

( * ) Notice: Subject to any disclaimer, the term of this patent is extended or adjusted under 35 U.S.C. 154(b) by 0 days.

(21) Appl. No.: 17/249,451

(22) Filed: Mar. 2, 2021

(65) Prior Publication Data

US 2021/0275378 A1 Sep. 9, 2021

Related U.S. Application Data

(60) Provisional application No. 62/984,665, filed on Mar. 3, 2020.

(51) Int. Cl.
*A61H 1/02* (2006.01)
*A63B 21/02* (2006.01)
(Continued)

(52) U.S. Cl.
CPC ..... *A61H 1/02* (2013.01); *A61H 1/0218* (2013.01); *A61H 1/0266* (2013.01);
(Continued)

(58) Field of Classification Search
CPC ..... A61H 1/02; A61H 1/0218; A61H 1/0259; A61H 1/0262; A61H 2201/0146; A61H 2201/0149; A61H 2201/1645; A61H 2201/1642; A61H 2201/1246; A61H 2201/0157; A61H 2201/1215; A61H 2201/1238; A61H 2201/5007;
(Continued)

(56) References Cited

U.S. PATENT DOCUMENTS 1,021,688 A * 3/1912 Le Jeune ..... A61H 1/0218 602/33
1,296,128 A 3/1919 Siebrandt
(Continued)

OTHER PUBLICATIONS

"thefreedictionary.com", Collins English Dictionary—Complete and Unabridged, "channel", 2014, HarperCollins Publishers, 12th Edition 2014 (Year: 2014).*
(Continued)

*Primary Examiner* — Tu A Vo
*Assistant Examiner* — Alexander Morales
(74) *Attorney, Agent, or Firm* — Womble Bond Dickinson US) LLP

(57) ABSTRACT

A device for applying a tensile force to a hinged joint is disclosed. The device may include a bracket having a first portion and a second portion insertable underneath a weighted object so as to restrain the device, a biasing element having a first end mounted toward a first end of the first portion and a second end arranged at an opposing second end of the first portion; and a strap removably attached to the second end of the biasing element and arranged to receive the hinged joint, wherein the biasing element applies a tensile force to the hinged joint so as to stretch the hinged joint longitudinally in response to a force exerted by the hinged joint upon receipt in the strap, and wherein the biasing element applies the tensile force to the hinged joint so as to passively stretch and relieve pressure on the ankle.

13 Claims, 20 Drawing Sheets

(51) Int. Cl.
*A63B 21/04* (2006.01)
*A63B 21/002* (2006.01)
*A63B 71/02* (2006.01)

(52) U.S. Cl.
CPC ..... *A63B 21/0023* (2013.01); *A63B 21/023* (2013.01); *A63B 21/0442* (2013.01); *A61H 2201/0146* (2013.01); *A61H 2201/0149* (2013.01); *A61H 2201/0161* (2013.01); *A61H 2201/0192* (2013.01); *A61H 2201/149* (2013.01); *A61H 2201/1642* (2013.01); *A61H 2201/1645* (2013.01); *A61H 2203/0456* (2013.01); *A63B 2071/027* (2013.01); *A63B 2208/0252* (2013.01); *A63B 2210/50* (2013.01)

(58) Field of Classification Search
CPC .... A61H 2201/5038; A61H 2201/5043; A61H 2201/5079; A61H 2203/0456; A61H 2230/065; A61H 2230/105; A61H 2230/208; A61H 2230/305; A61H 2230/605; A63B 21/023; A63B 21/0442; A63B 21/4015; A63B 1/0023; A63B 2023/006; A63B 23/00; A63B 23/08; A63B 23/03533; A63B 23/0488; A63B 23/085; A63B 2210/50; A63B 2208/0228
USPC ..... 128/75, 84; 482/91, 92, 79; 602/32, 33, 602/35, 36; 606/241, 242
See application file for complete search history.

(56) References Cited

U.S. PATENT DOCUMENTS 1,374,115 A 4/1921 Roemer
1,746,111 A 2/1930 Fisher
1,837,037 A 12/1931 Gillberg
2,230,620 A 2/1941 Leiter
3,117,572 A 1/1964 Wright
3,153,411 A 10/1964 Unks
3,385,292 A 5/1968 Hardy
3,713,437 A 1/1973 Wiedmer
3,826,490 A * 7/1974 Mossman ..... A63B 21/154 482/94
3,978,853 A 9/1976 Morrison
4,181,125 A * 1/1980 Carlson ..... A61H 1/0218 602/33
4,534,076 A 8/1985 Barge
4,538,598 A * 9/1985 Gill ..... A61H 1/0218 602/33
4,674,484 A * 6/1987 Kott ..... A63B 21/0602 248/164
4,865,022 A * 9/1989 Gorsen ..... A61H 1/0218 602/33
5,449,336 A * 9/1995 Sabel ..... A61H 1/0218 482/133
5,478,307 A 12/1995 Wang
5,676,158 A * 10/1997 Katzman ..... A61H 1/0218 128/845
5,820,519 A * 10/1998 Slenker ..... A63B 21/015 482/4
5,820,532 A 10/1998 Oliver
6,007,507 A 12/1999 Ledany
6,258,050 B1 * 7/2001 Henderson ..... A61H 1/0218 602/32
6,428,496 B1 8/2002 Sargent
7,282,039 B2 10/2007 Henke
7,883,453 B1 2/2011 Cooper
9,173,649 B2 11/2015 Clark et al.
9,205,296 B1 * 12/2015 Cook ..... A61H 1/0218 128/845
2004/0002410 A1 * 1/2004 Steinbach ..... A61H 1/0222 482/121
2006/0161084 A1 * 7/2006 Henke ..... A61F 5/04 602/32
2008/0119338 A1 * 5/2008 Prsala ..... A63B 21/0552 482/142
2009/0199338 A1 * 8/2009 House ..... A47C 31/00 5/503.1
2012/0071305 A1 3/2012 Berkoff
2015/0165256 A1 * 6/2015 Salamon ..... A63B 23/1281 482/129
2016/0213969 A1 7/2016 Berkoff
2018/0303696 A1 10/2018 Koenig et al.

OTHER PUBLICATIONS

"thefreedictionary.com", Random House Kernerman Webster's College Dictionary, "conduit", 2010, © 2010 K Dictionaries Ltd. (Year :2010).*

* cited by examiner

DEVICE FOR APPLYING A TENSILE FORCE TO A HINGED JOINT

CROSS-REFERENCE TO RELATED APPLICATIONS

This application claims priority to, and the benefit of, U.S. Provisional Patent Application No. 62/984,665, titled Device for Applying a Tensile Force to a Hinged Joint, filed on Mar. 3, 2020, which is incorporated herein in its entirety by reference.

TECHNOLOGY FIELD

The present disclosure relates to stretching devices, and more particularly to a device for passively applying a tensile force to a hinged or articulating joint, encompassing joints from head to feet.

BACKGROUND

After injury and discomfort from numerous modes of physical activity, age related discomfort and pain to the body, treatment including physical therapy or chiropractic care may be required so as to straighten and strengthen a hinged joint, stretch connective tissue, membranes, and cartilage, increase flexibility of articulation, relieve irritation or impingement of nerves, and the like. However, physical therapy and chiropractic care require a certified healthcare provider in a medical environment to perform such treatment, which in some cases, may be expensive, inconvenient, and time-consuming.

Accordingly, a need exists for a device for passively applying a tensile force to a hinged joint, which can provide benefits similar to those provided by a healthcare provider, and can be used within a user's domicile.

BRIEF SUMMARY

The present disclosure relates to a device for applying a tensile force to a hinged joint. In this regard, various implementations of the disclosure provide a device for applying a tensile force to a hinged joint with advantageous usability features, including, for example, an adjustable, collapsible frame comprising two elements, which can be folded or disassembled and stored when not in use, and when in use, can be inserted under a couch, mattress, futon, etc., to apply a tensile force to the hinged joint so as to passively stretch and relieve pressure on connective tissue, membranes, and cartilage of a hinged joint, such as, for example, the ankle, which propagates and/or transmits this force to other joints distally connected such as, for example, the knees, the torso, the hips, etc.

In some example implementations, a device for applying a tensile force to a hinged joint comprises a bracket having a first portion and a second portion such that the first portion and the second portion are perpendicular to one another in a first position, the second portion being insertable underneath a weighted object, or otherwise fixed, so as to restrain the device; a biasing element extending from a first end to an opposing second end, the first end of the biasing element being mounted toward a first end of the first portion and the second end of the biasing element being arranged at an opposing second end of the first portion; and a strap removably attached to the second end of the biasing element and arranged to receive the hinged joint, wherein the biasing element applies a tensile force to the hinged joint so as to stretch the hinged joint longitudinally in response to a force exerted by the hinged joint upon receipt thereof in the strap, and wherein the biasing element applies the tensile force to the hinged joint so as to passively stretch and relieve pressure on connective tissue, membranes, and cartilage of the various skeletal structures. These and other features, aspects, and advantages of the disclosure will be apparent from a reading of the following detailed description together with the accompanying drawings, which are briefly described below.

BRIEF DESCRIPTION OF THE DRAWINGS

Figure 1A:
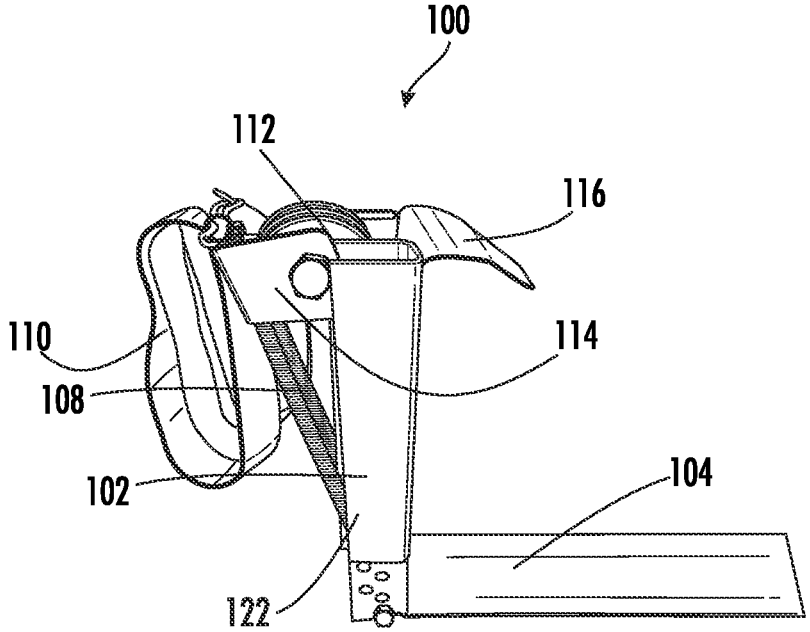
Figure 1B:
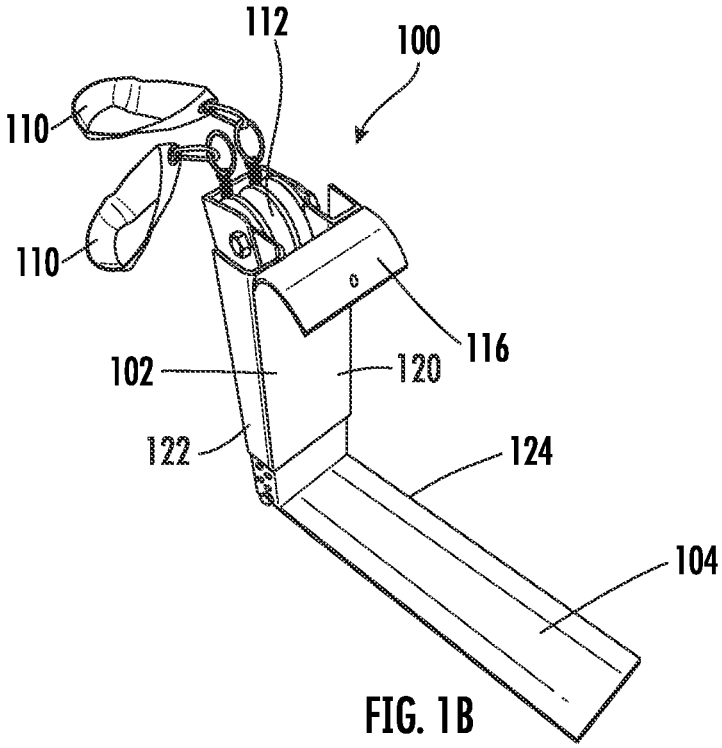
Figure 1C:
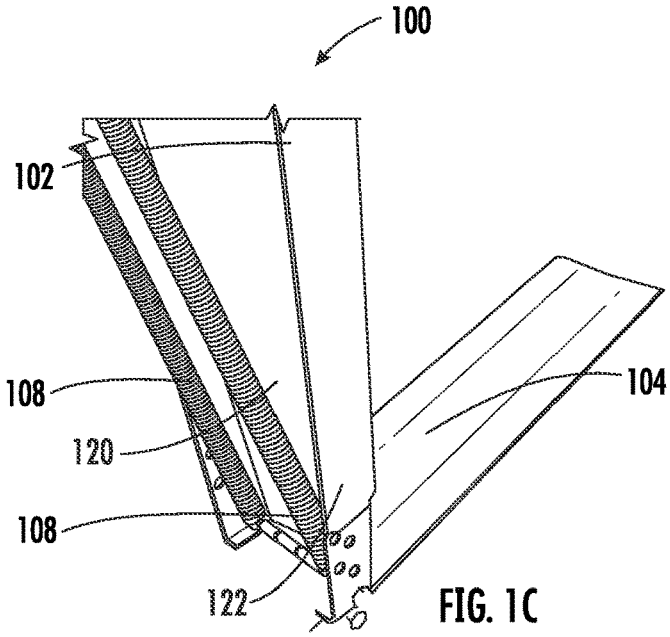
Figure 1D:
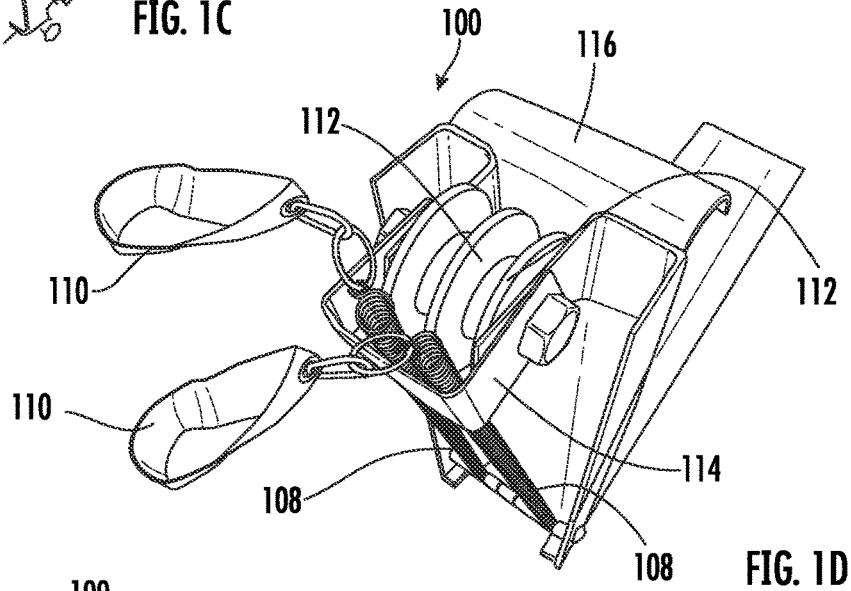
Figure 1E:
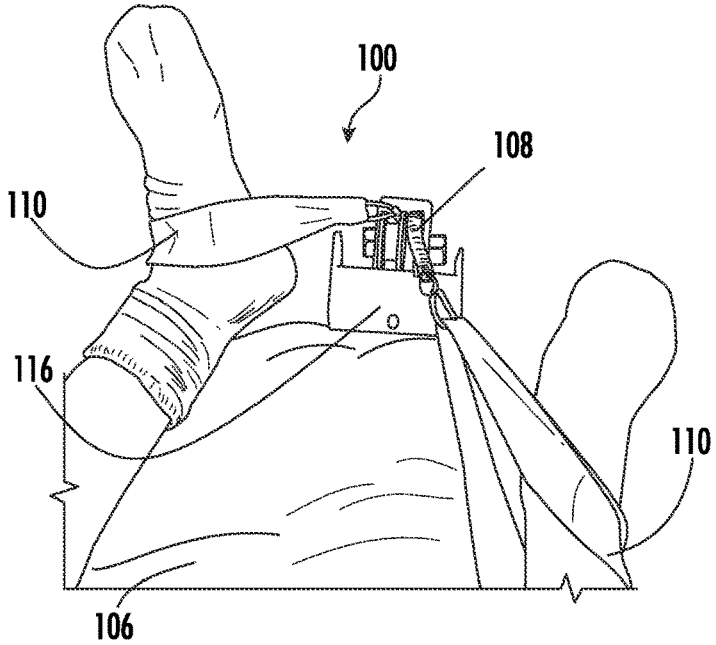
Figure 1F:
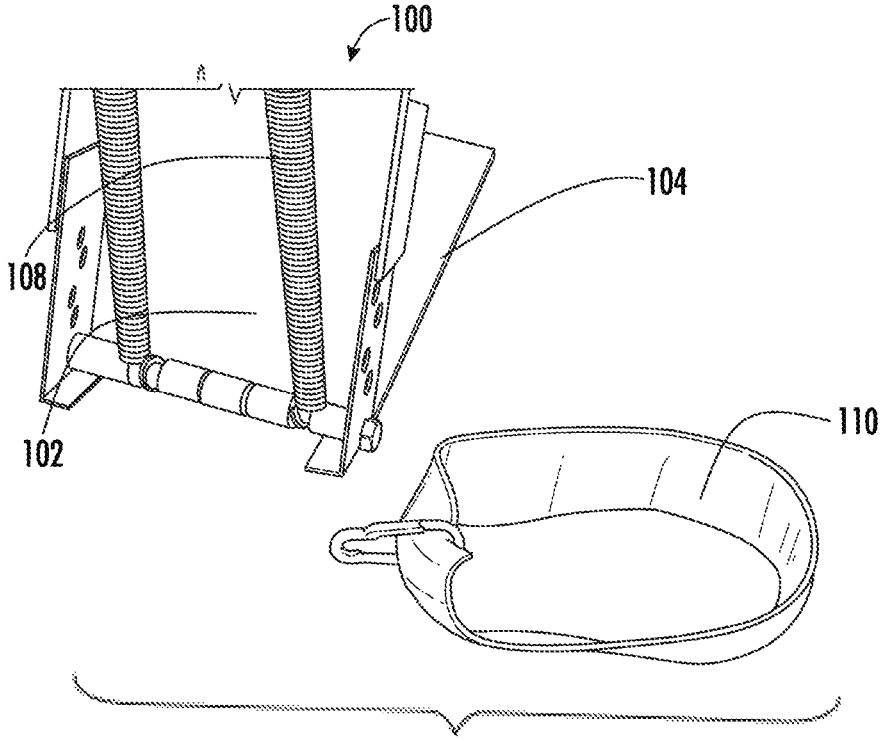
Figure 1G:
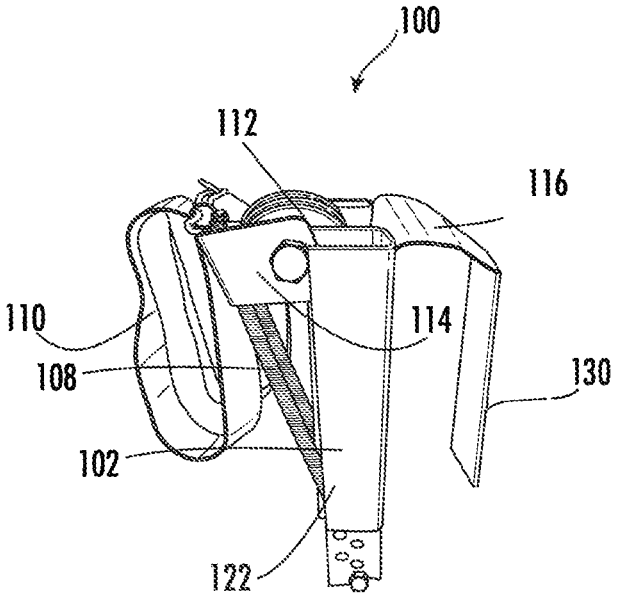
Figure 2A:
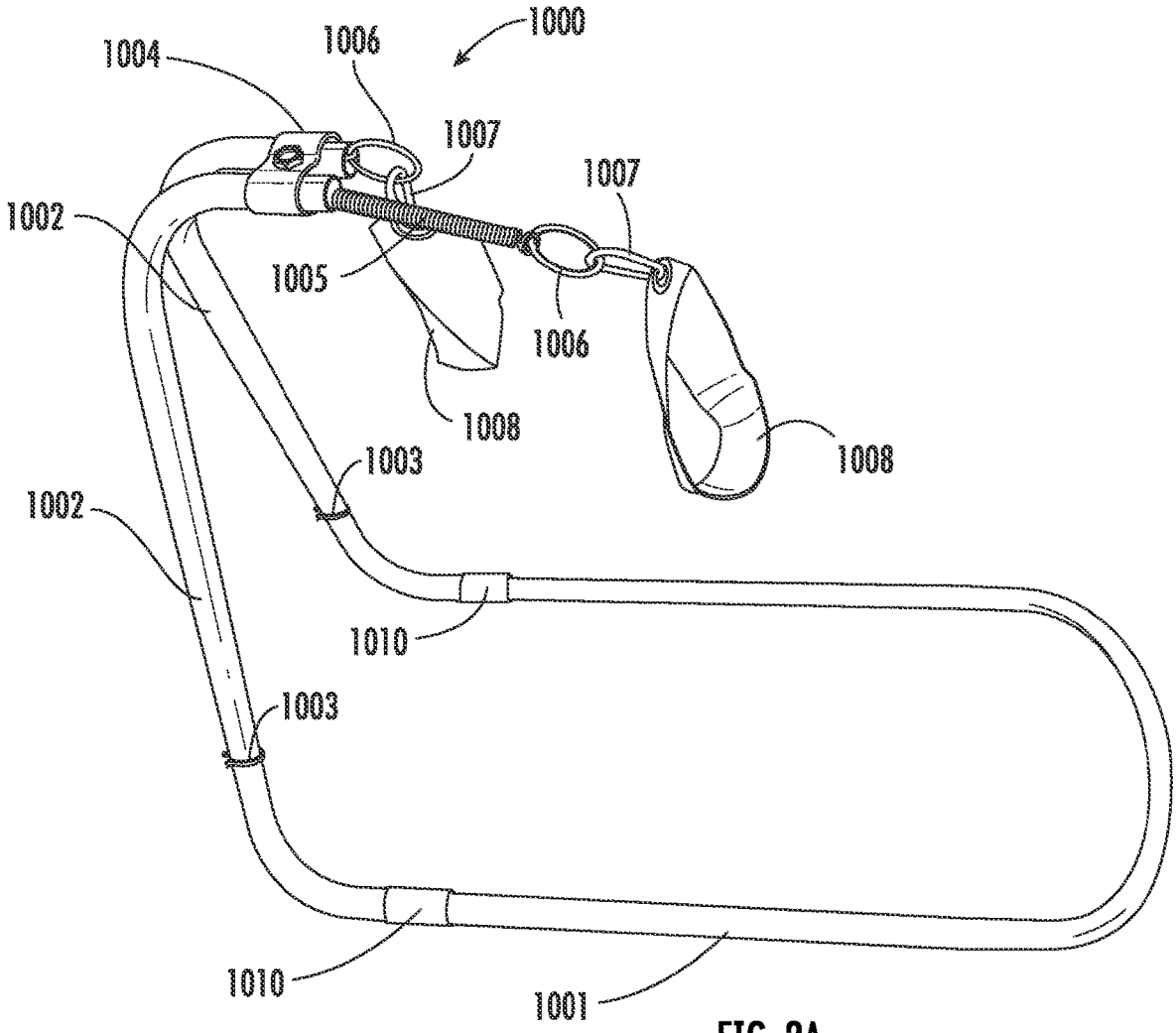
Figure 2B:
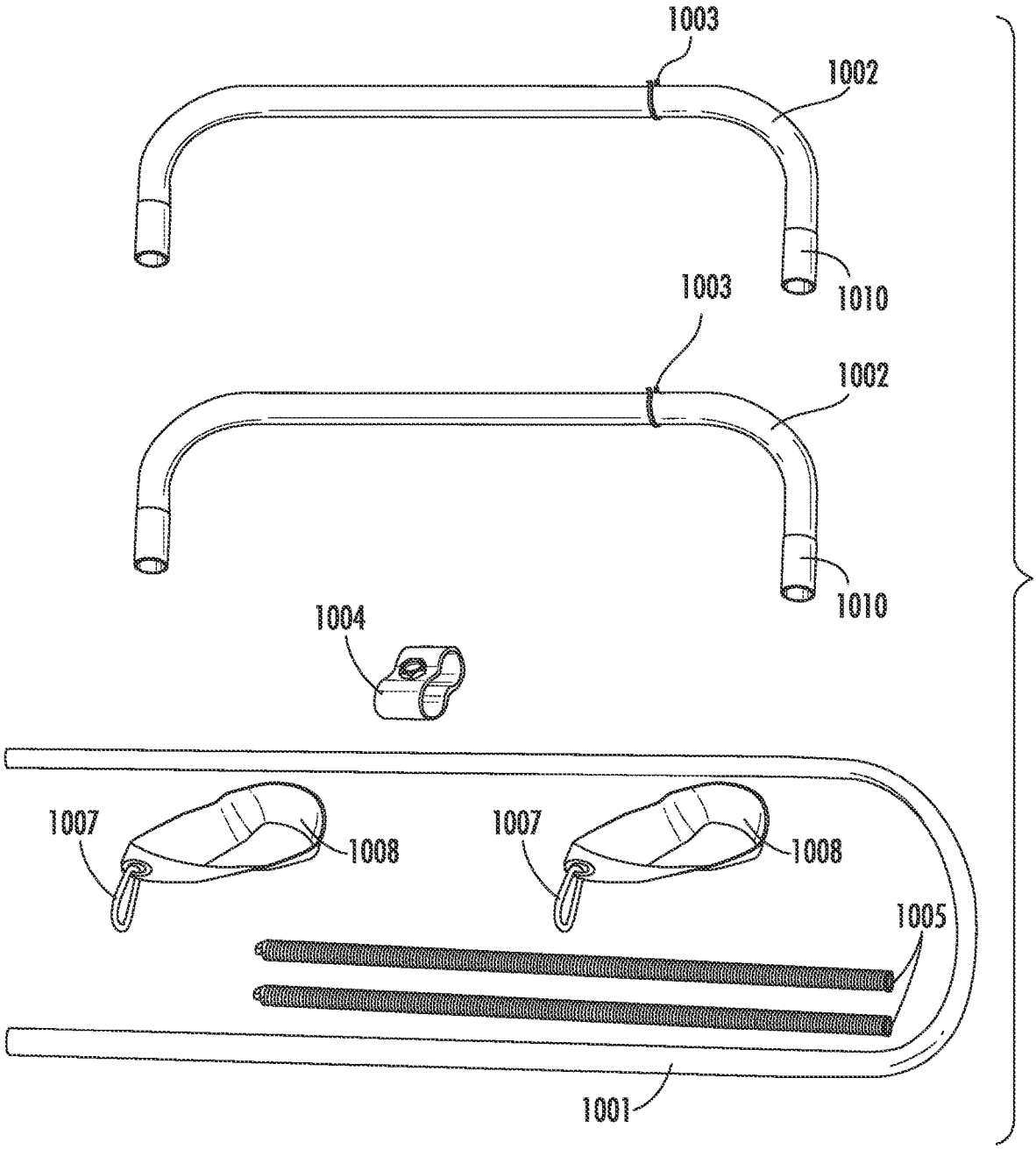
Figure 2C:
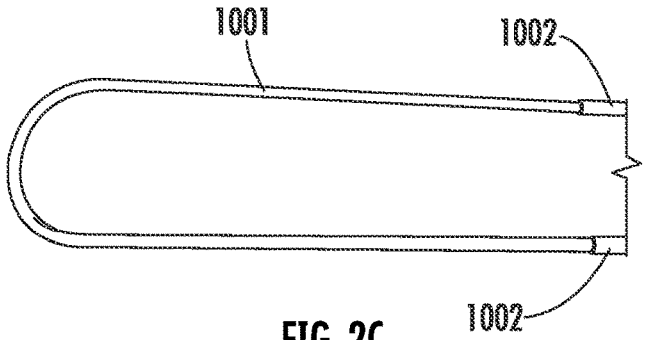
Figure 2D:
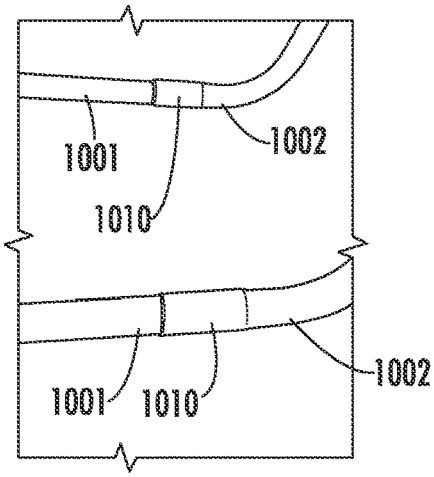
Figure 2E:
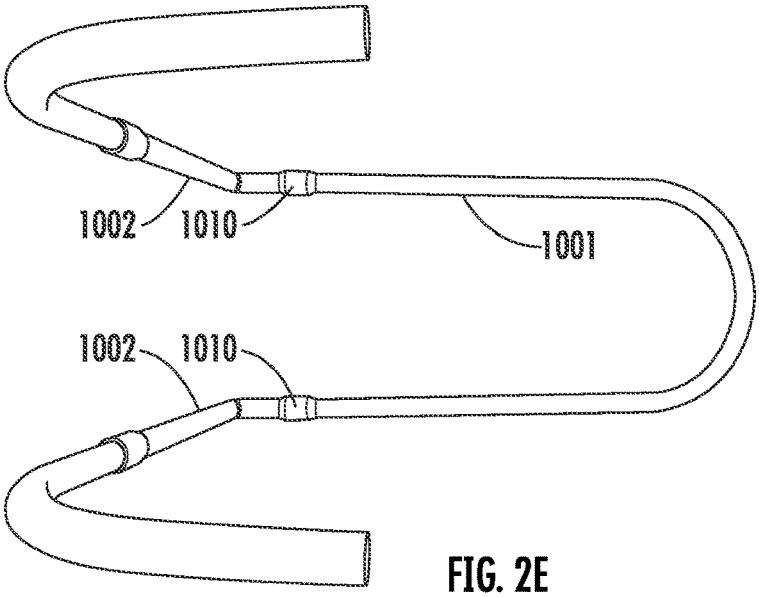
Figure 2F:
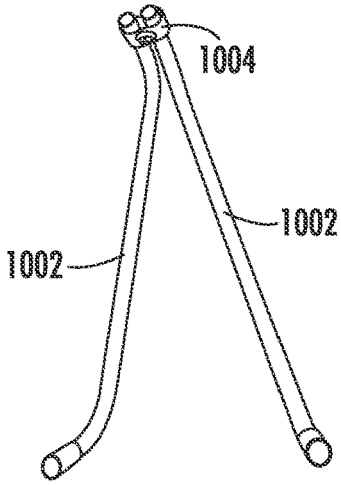
Figure 2G:
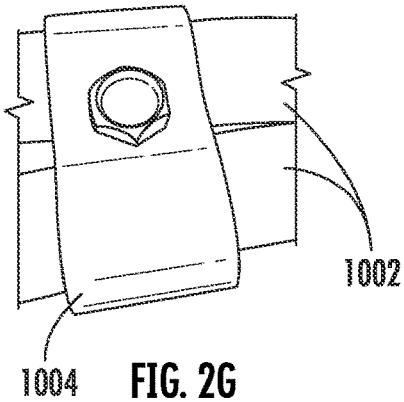
Figure 2H:
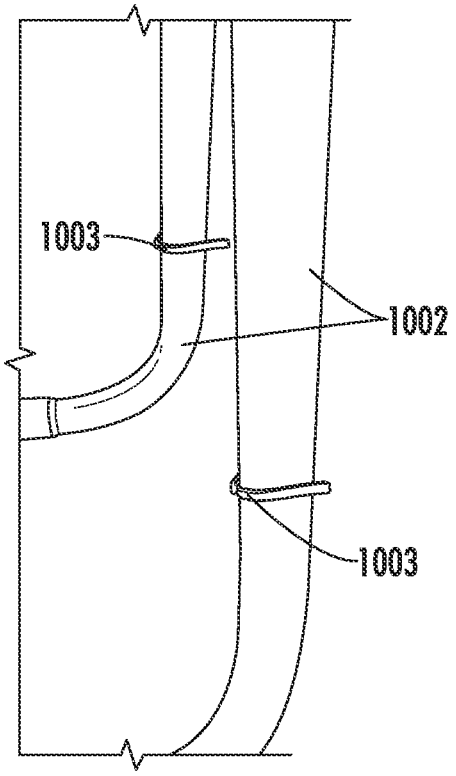
Figure 2I:
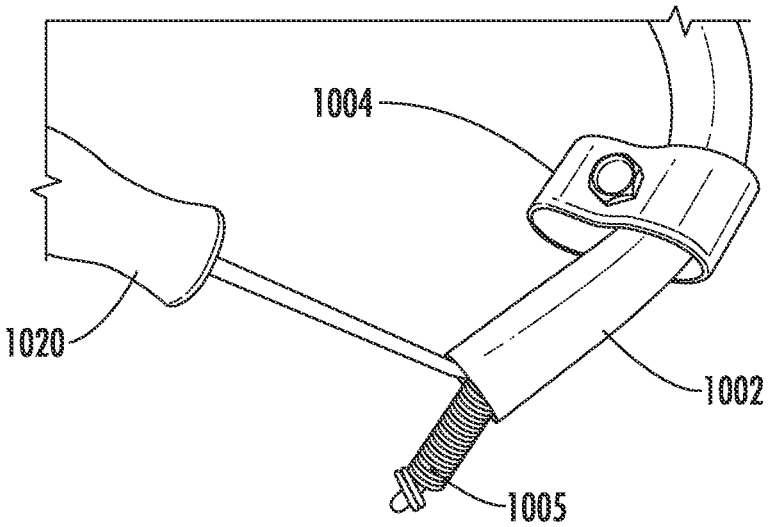
Figure 2J:
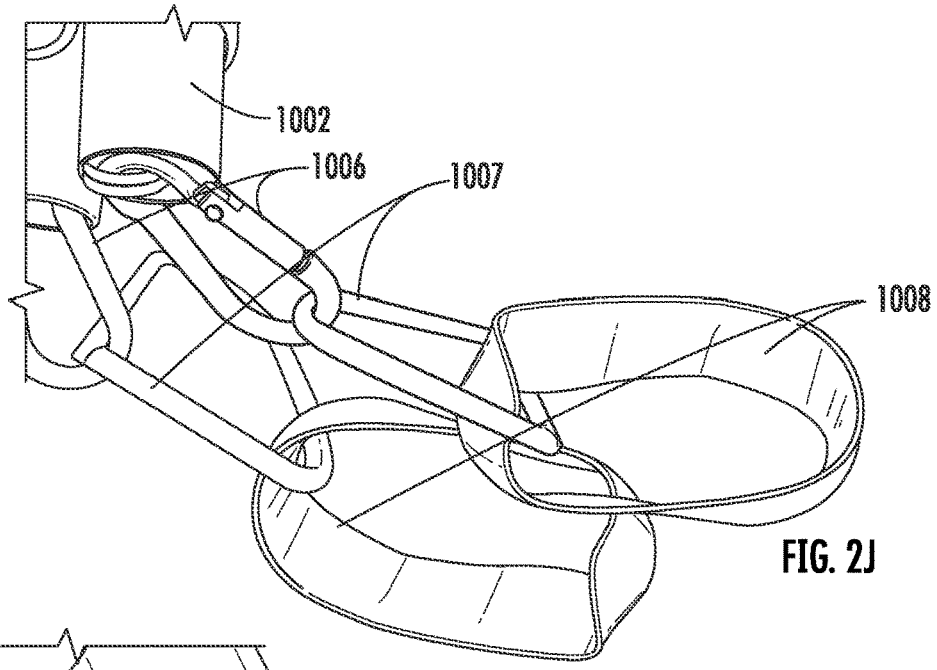
Figure 2K:
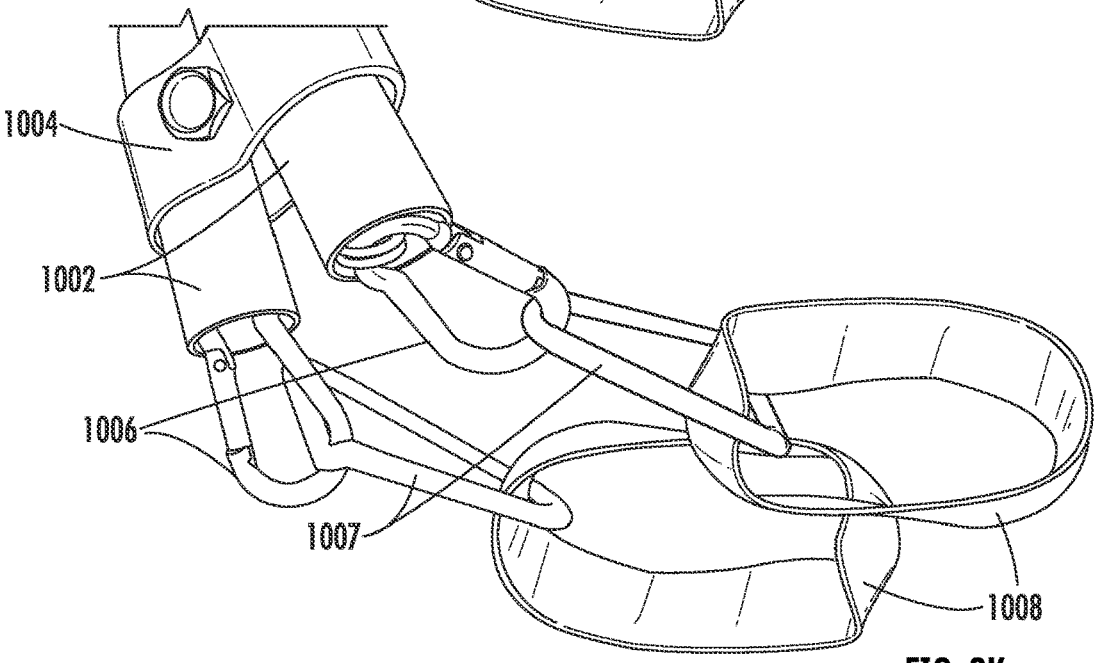
Figure 2L:
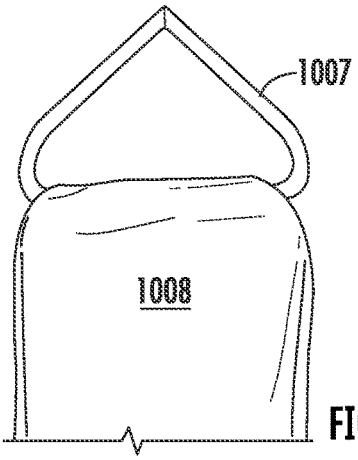
Figure 3A:
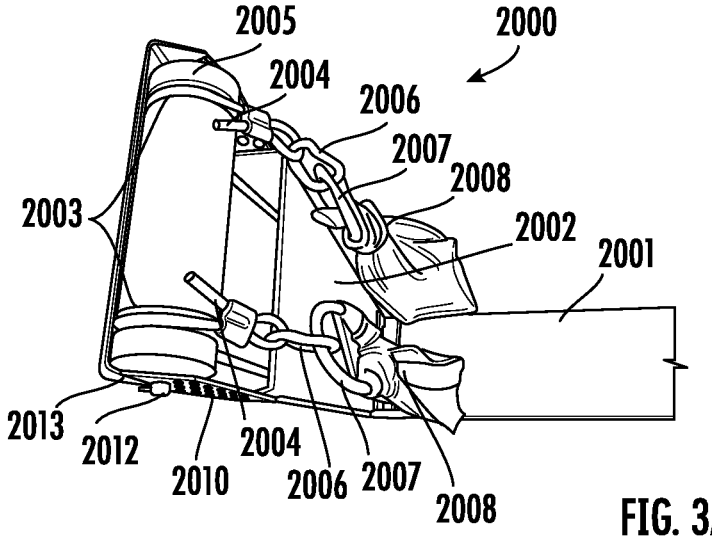
Figure 3B:
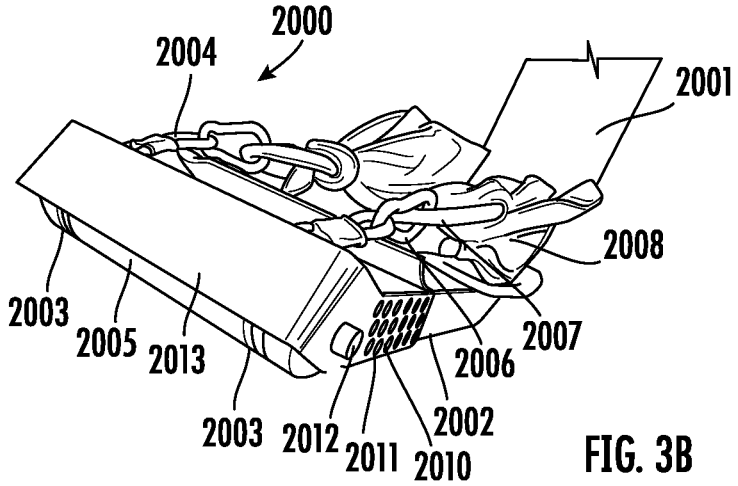
Figure 3C:
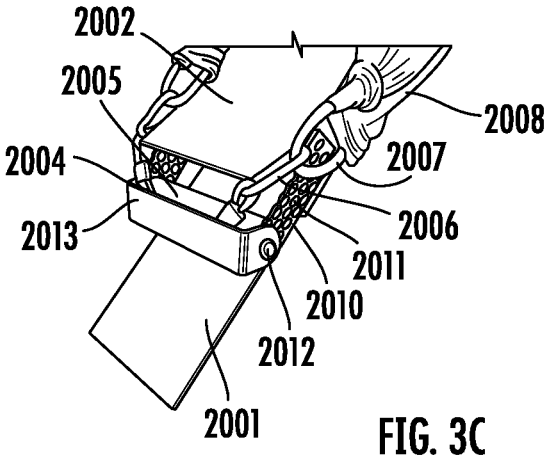
Figure 3D:
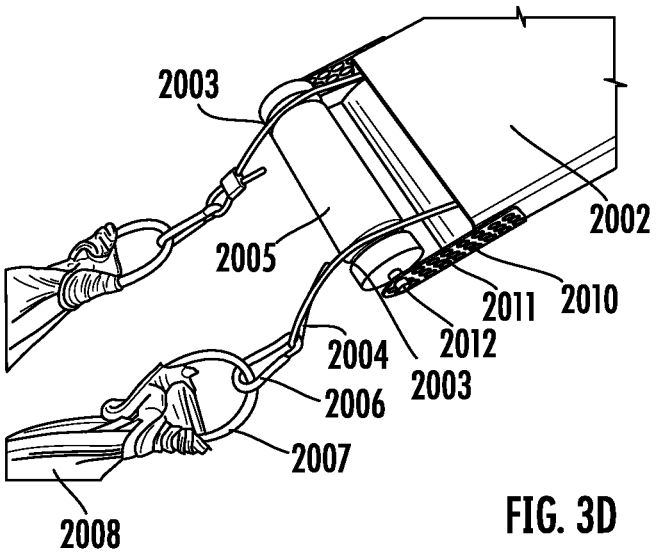
Figure 3E:
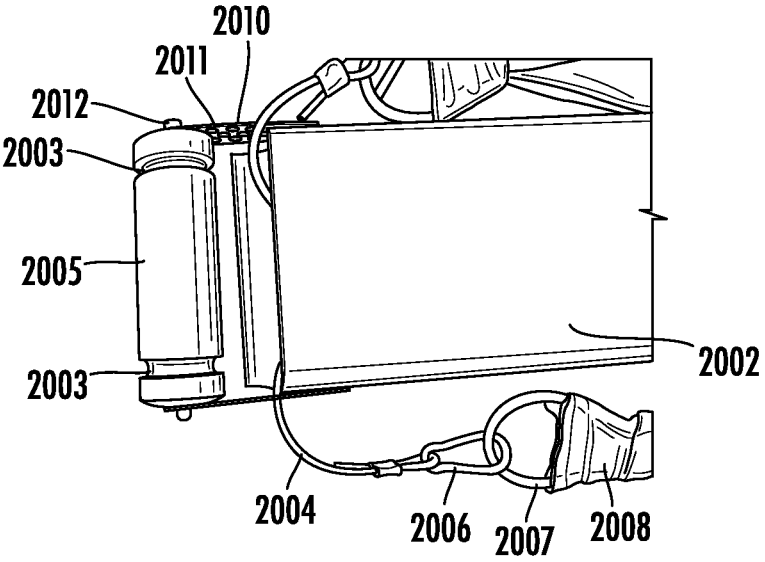
Figure 3F:
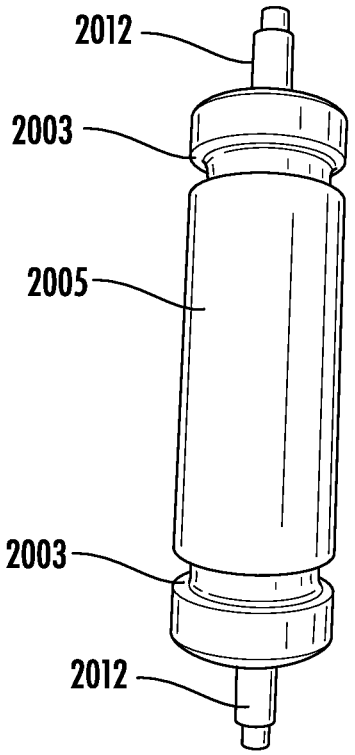
Figure 3G:
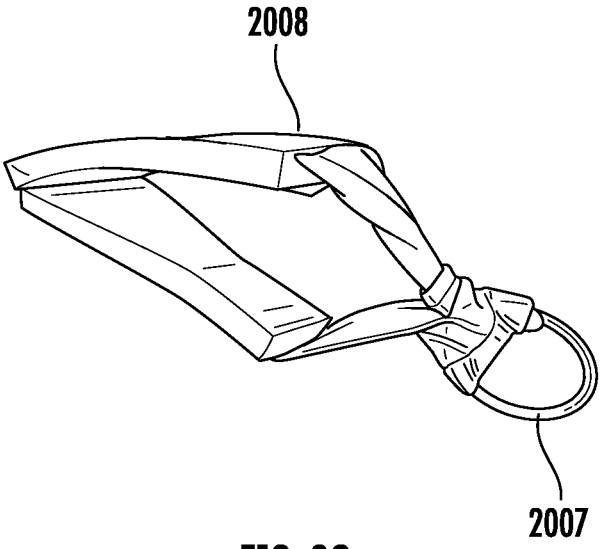
Figure 3H:
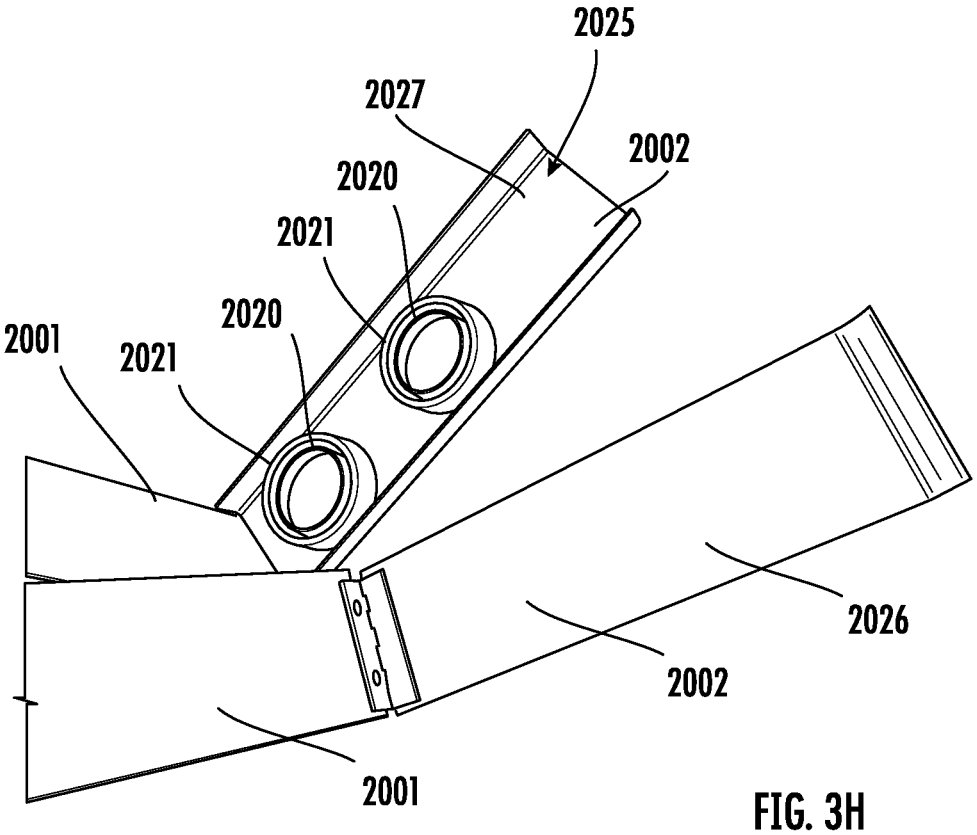
Figure 3I:
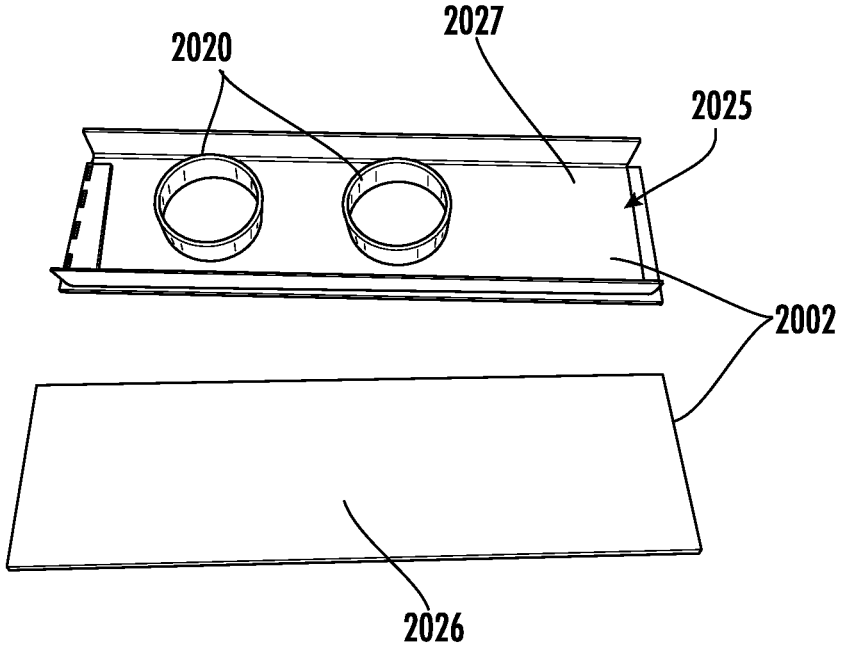
Figure 3L:
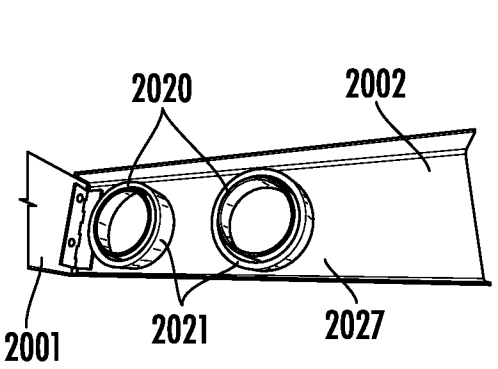
Figure 3K:
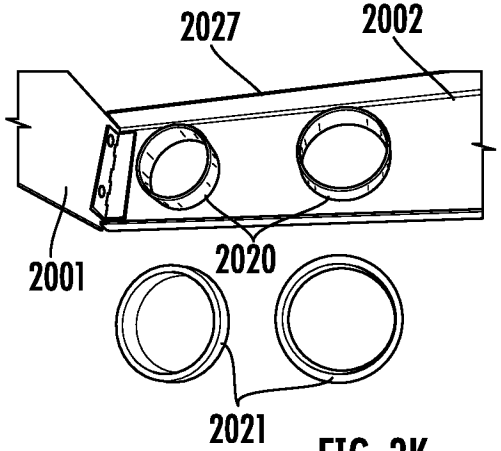
Figure 3J:
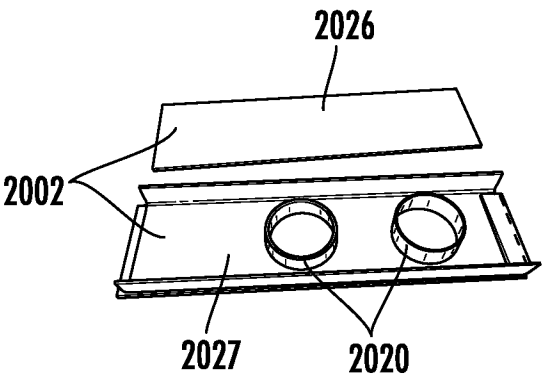
Figure 3N:
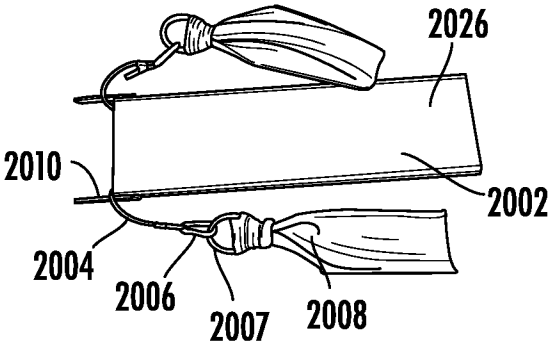
Figure 3M:
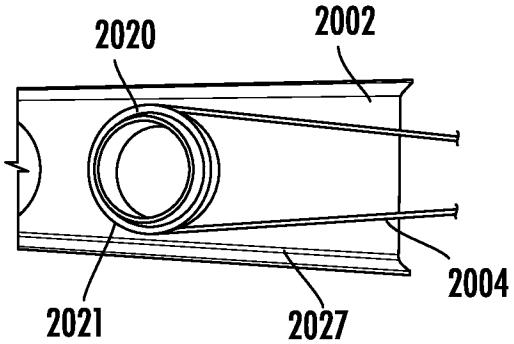
Figure 4A:
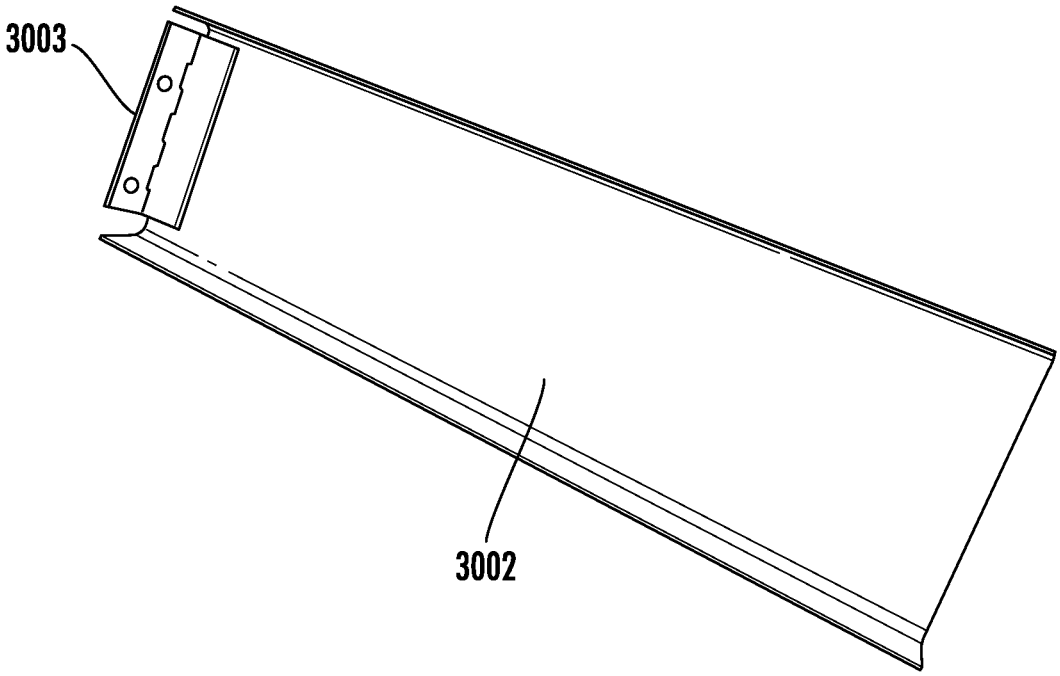
Figure 4B:
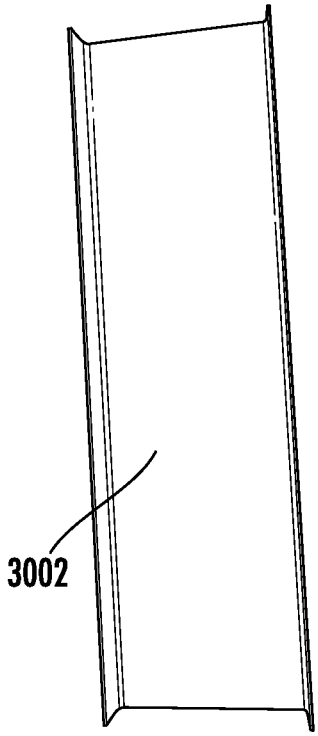
Figure 4C:
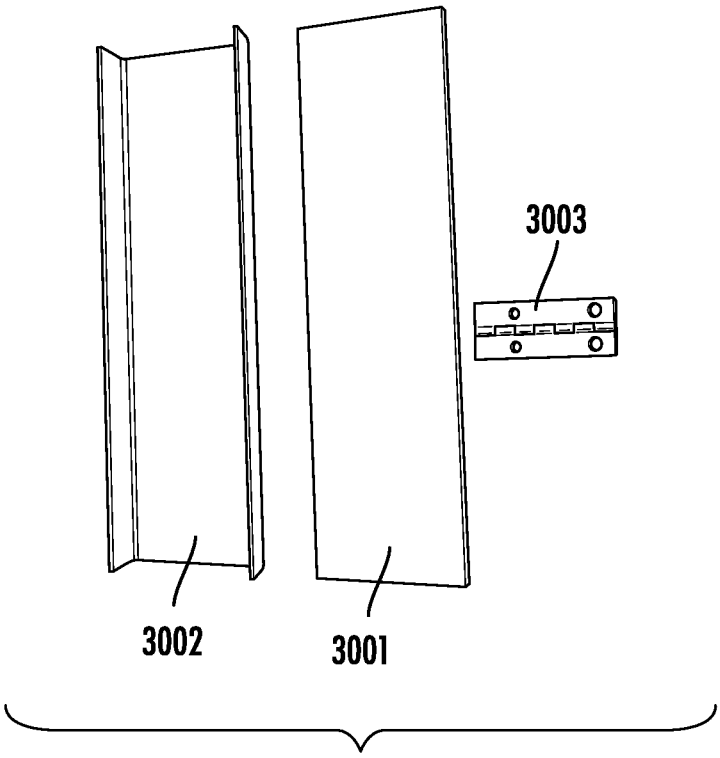
Figure 4D:
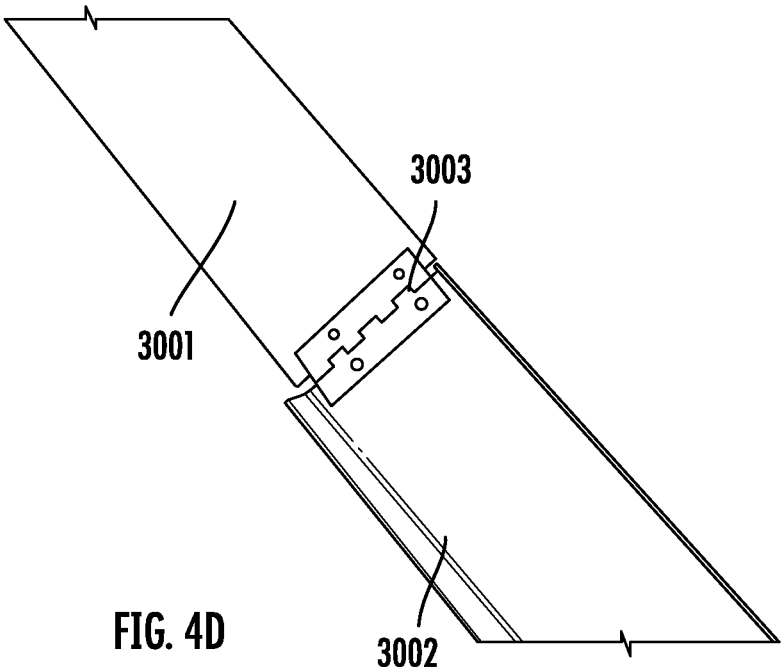
Figure 4E:
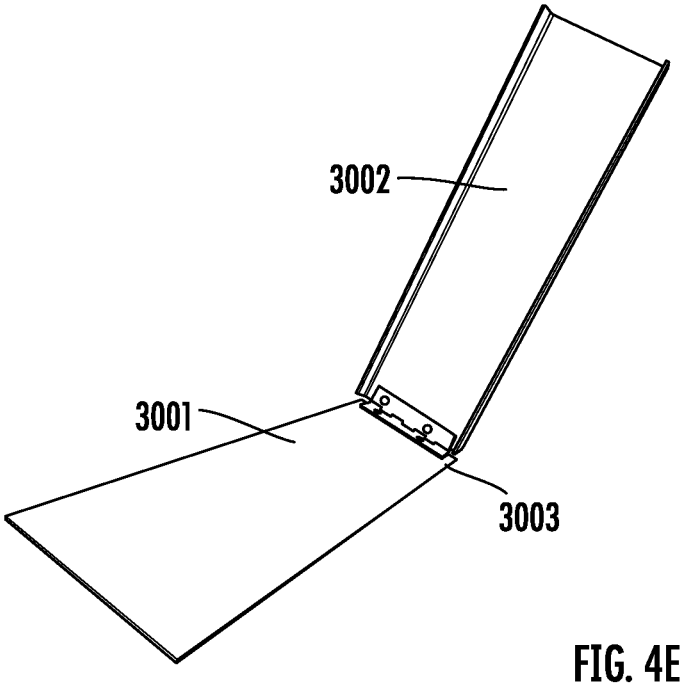
Figure 4F:
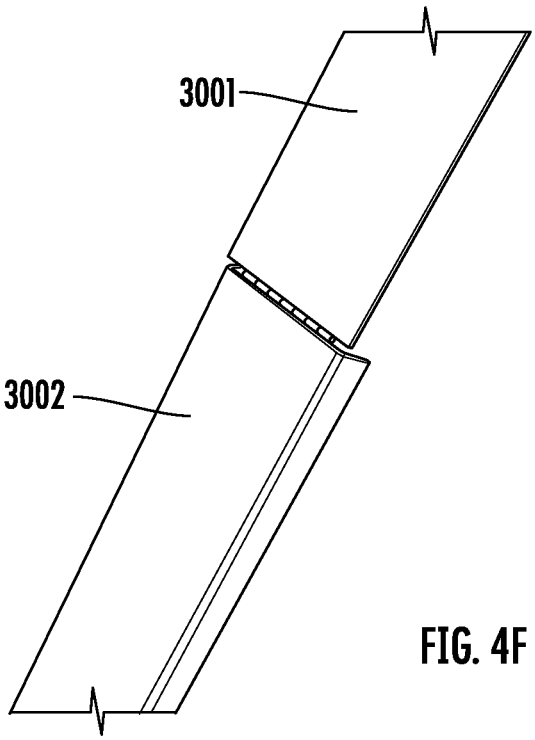
Figure 4G:
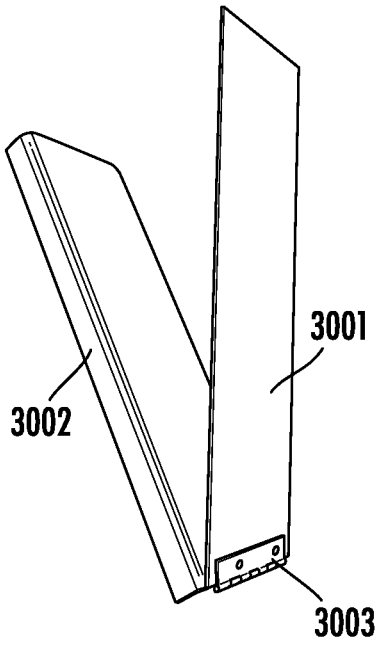
Figure 4H:
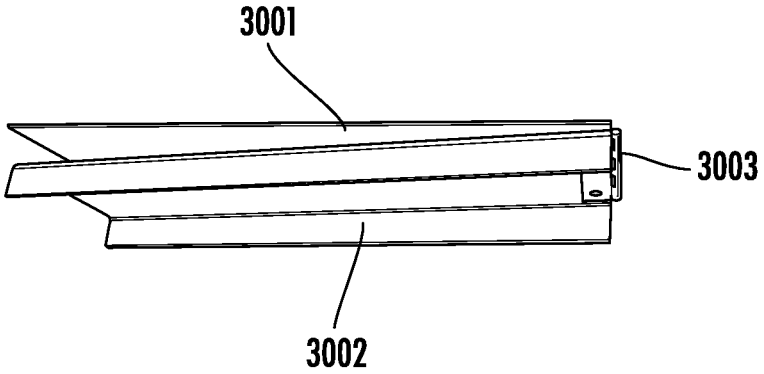
Figure 4I:
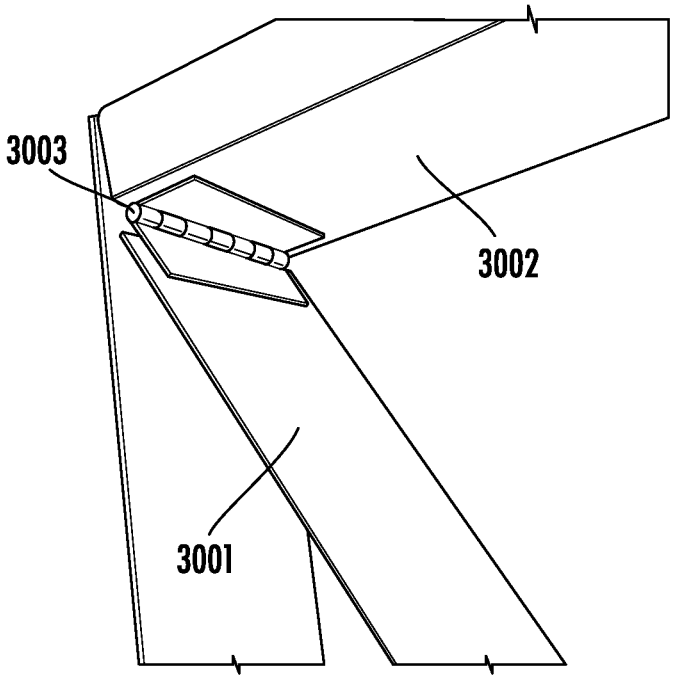
Figure 4J:
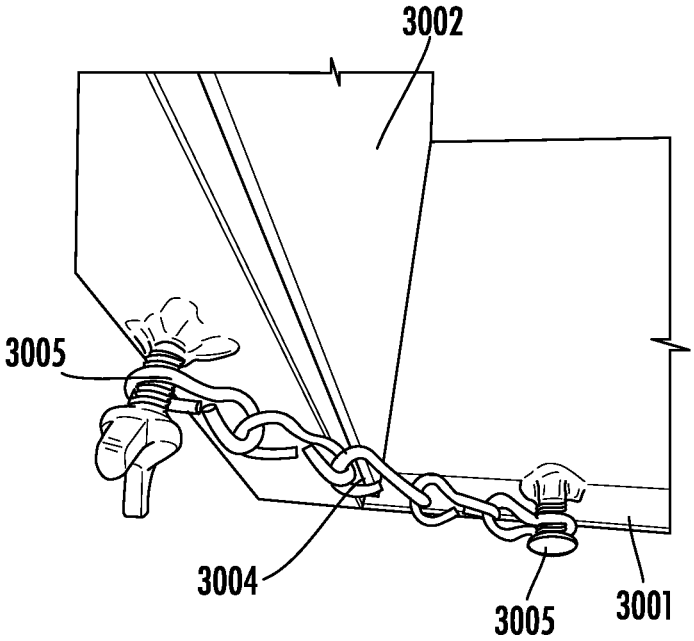
Figure 5A:
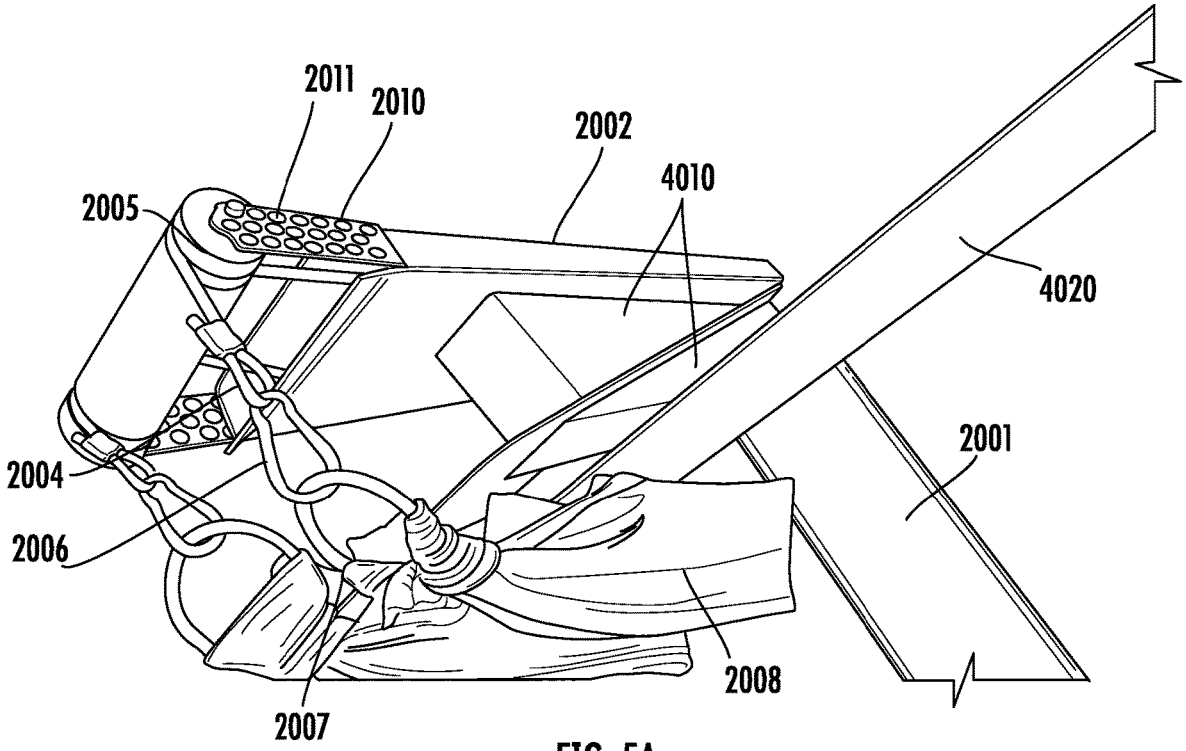
Figure 5B:
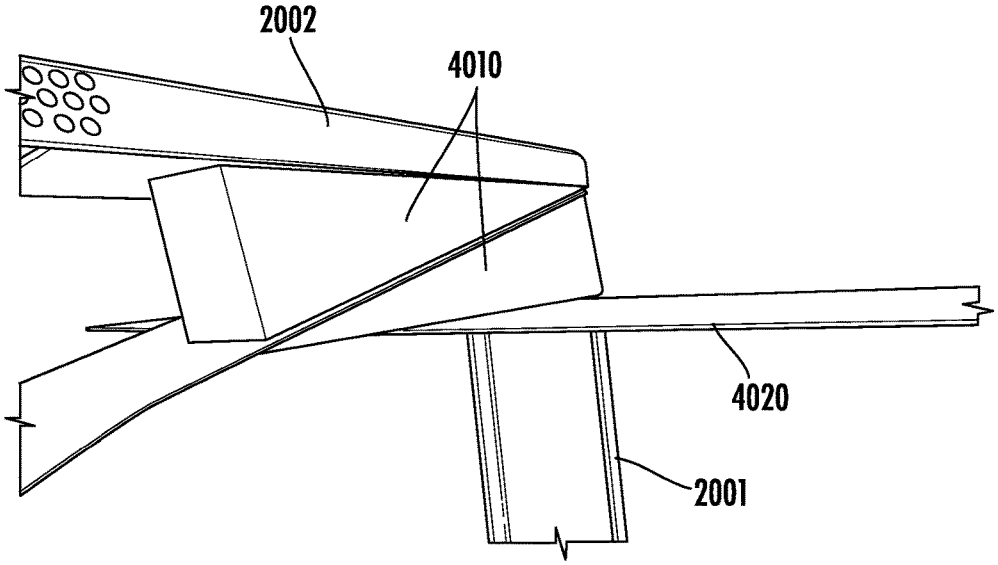
Figure 5C:
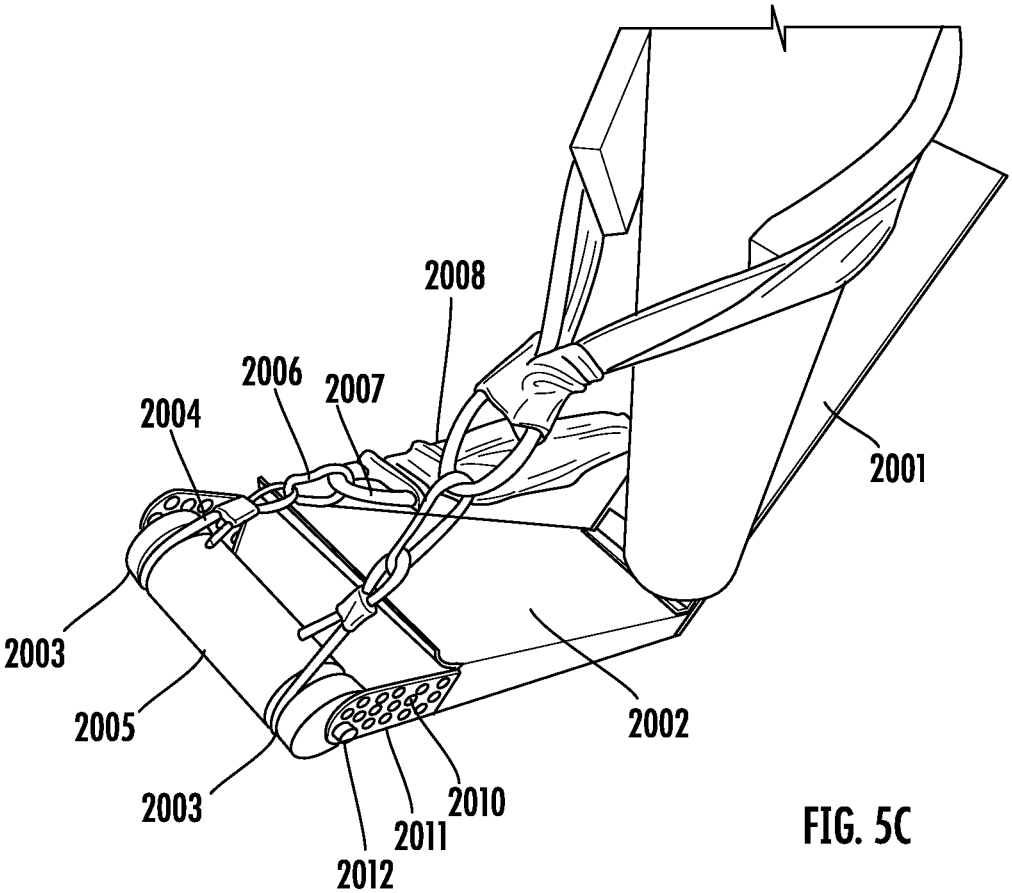

Having thus described the disclosure in the foregoing general terms, reference will now be made to the accompanying drawings, which are not necessarily drawn to scale, and wherein:

FIG. 1A illustrates a view of a device for applying a tensile force to a hinged joint according to example implementations of the present disclosure;

FIG. 1B illustrates a view of a device for applying a tensile force to a hinged joint according to example implementations of the present disclosure;

FIG. 1C illustrates a view of a portion of a device for applying a tensile force to a hinged joint according to example implementations of the present disclosure;

FIG. 1D illustrates a view of a device for applying a tensile force to a hinged joint according to example implementations of the present disclosure;

FIG. 1E illustrates a view of a portion of a device for applying a tensile force to a hinged joint according to example implementations of the present disclosure;

FIG. 1F illustrates a view of a portion of a device for applying a tensile force to a hinged joint according to example implementations of the present disclosure;

FIG. 1G illustrates a view a device for applying a tensile force to a hinged joint according to example implementations of the present disclosure;

FIG. 2A illustrates a view of a device for applying a tensile force to a hinged joint according to example implementations of the present disclosure;

FIG. 2B illustrates a view of components of a device for applying a tensile force to a hinged joint according to example implementations of the present disclosure;

FIG. 2C illustrates a view of components of a device for applying a tensile force to a hinged joint according to example implementations of the present disclosure;

FIG. 2D illustrates a view of components of a device for applying a tensile force to a hinged joint according to example implementations of the present disclosure;

FIG. 2E illustrates a view of components of a device for applying a tensile force to a hinged joint according to example implementations of the present disclosure;

FIG. 2F illustrates a view of components of a device for applying a tensile force to a hinged joint according to example implementations of the present disclosure;

FIG. 2G illustrates a view of components of a device for applying a tensile force to a hinged joint according to example implementations of the present disclosure;

FIG. 2H illustrates a view of components of a device for applying a tensile force to a hinged joint according to example implementations of the present disclosure;

FIG. 2I illustrates a view of components of a device for applying a tensile force to a hinged joint according to example implementations of the present disclosure;

FIG. 2J illustrates a view of components of a device for applying a tensile force to a hinged joint according to example implementations of the present disclosure;

FIG. 2K illustrates a view of components of a device for applying a tensile force to a hinged joint according to example implementations of the present disclosure;

FIG. 2L illustrates a view of components of a device for applying a tensile force to a hinged joint according to example implementations of the present disclosure;

FIG. 3A illustrates a view of a device for applying a tensile force to a hinged joint according to example implementations of the present disclosure;

FIG. 3B illustrates a view of a portion of a device for applying a tensile force to a hinged joint according to example implementations of the present disclosure;

FIG. 3C illustrates a view of a portion of a device for applying a tensile force to a hinged joint according to example implementations of the present disclosure;

FIG. 3D illustrates a view of a portion of a device for applying a tensile force to a hinged joint according to example implementations of the present disclosure;

FIG. 3E illustrates a view of a portion of a device for applying a tensile force to a hinged joint according to example implementations of the present disclosure;

FIG. 3F illustrates a view of components of a device for applying a tensile force to a hinged joint according to example implementations of the present disclosure;

FIG. 3G illustrates a view of components of a device for applying a tensile force to a hinged joint according to example implementations of the present disclosure;

FIG. 3H illustrates a view of components of a device for applying a tensile force to a hinged joint according to example implementations of the present disclosure;

FIG. 3I illustrates a view of components of a device for applying a tensile force to a hinged joint according to example implementations of the present disclosure;

FIG. 3J illustrates a view of components of a device for applying a tensile force to a hinged joint according to example implementations of the present disclosure;

FIG. 3K illustrates a view of components of a device for applying a tensile force to a hinged joint according to example implementations of the present disclosure;

FIG. 3L illustrates a view of components of a device for applying a tensile force to a hinged joint according to example implementations of the present disclosure;

FIG. 3M illustrates a view of components of a device for applying a tensile force to a hinged joint according to example implementations of the present disclosure;

FIG. 3N illustrates a view of components of a device for applying a tensile force to a hinged joint according to example implementations of the present disclosure;

FIG. 4A illustrates a view of components of a hinged device according to example implementations of the present disclosure;

FIG. 4B illustrates a view of components of a hinged device according to example implementations of the present disclosure;

FIG. 4C illustrates a view of components of a hinged device according to example implementations of the present disclosure;

FIG. 4D illustrates a view of components of a hinged device according to example implementations of the present disclosure;

FIG. 4E illustrates a view of components of a hinged device according to example implementations of the present disclosure;

FIG. 4F illustrates a view of components of a hinged device according to example implementations of the present disclosure;

FIG. 4G illustrates a view of components of a hinged device according to example implementations of the present disclosure;

FIG. 4H illustrates a view of components of a hinged device according to example implementations of the present disclosure;

FIG. 4I illustrates a view of components of a hinged device according to example implementations of the present disclosure;

FIG. 4J illustrates a view of components of a hinged device according to example implementations of the present disclosure;

FIG. 5A illustrates a view of a portion of a device for applying a tensile force to a hinged joint according to example implementations of the present disclosure;

FIG. 5B illustrates a view of a portion of a device for applying a tensile force to a hinged joint according to example implementations of the present disclosure; and FIG. 5C illustrates a view of a portion of a device for applying a tensile force to a hinged joint according to example implementations of the present disclosure.

DETAILED DESCRIPTION

The present disclosure will now be described more fully hereinafter with reference to example embodiments thereof. These example embodiments are described so that this disclosure will be thorough and complete, and will fully convey the scope of the disclosure to those skilled in the art. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure relates generally to a device that may be used in connection with a hinged joint, such as a human ankle, as a locating point to convey tension to the body. However, the present disclosure also contemplates that the device disclosed herein may also be used in connection with other hinged joints, such as human elbows and upper torso. Further use of the device on the hinged joint, also enables the tensile force to propagate to other body parts, for example this force may be transmitted from a hinge joint to all joints distally connected. Advantageously, the device disclosed herein may be used by a human user with little or no medical experience and in a home environment, so as to avoid the inconvenience of obtaining a healthcare provider whose costs associated may be expensive, and whose healthcare practice may be geographically undesirable. An overview of an embodiment of the present disclosure is provided followed by further example implementations.

Referring to FIGS. 1A-1G, various views of an example implementation of a device, generally designated 100, for applying a tensile force to a hinged joint are illustrated. Notably, use of the device on one hinged joint results in propagating the tensile force to other body parts. For example, using the device 100 on a human ankle exerts tension on the human ankle, which propagates beyond the ankle joint to the knees and torso. In this example, the tensile force is attenuated by frictional resistance as it is exerted approaching the head. Further, where additional restraints are provided under the arms, the tensioning becomes more uniform from the spine to the ankles.

The device may include a bracket having a first portion 102 and a second portion 104. The first portion 102 and the second portion 104 may be arranged relative to one another such that the first portion 102 and the second portion 104 are perpendicular or substantially perpendicular (about 90 degrees) to one another in a first position. In various implementations, different angles are possible, including angles greater than 90 degrees or angles less than 90 degrees. A length of the first portion 102 may be shorter than a length of the second portion 104, such that, for example, when a first end of the first portion 102 is attached to a first end of the second portion 104, the first portion 102 and the second portion 104 form an "L" shape. However, the lengths of each of the first portion 102 and the second portion 104 may vary, such that the length of the second portion 104 may be shorter than a length of the first portion 102 and/or may be arranged relative to one another such that they are not perpendicular in the first position.

In some example implementations, the first portion 102 and/or the second portion 104 are made of a metal (e.g., steel), a polymer, wood, or any combination thereof. The first and second portions may be arranged in a variety of different manners. For example, in FIGS. 1A-F these portions comprise rectangular sheet metal panels, and in this embodiment the first portion 102 comprises a front panel 120 and side panels 122 arranged perpendicular to front panel 120 and provide depth to the first portion 102. In the depicted embodiment, the second portion 104 comprises a flat panel 124. In some embodiments, the first and/or second portion comprise tubes or conduits. In some embodiments, the first and/or second portion are made up of two or more tubes or conduits that connect, and in some embodiments, these tubes or conduits are hollow and allow other components to be inserted inside the hollow space. Other materials and configurations for the first and second portion are contemplated within the scope of this disclosure.

In various implementations, the first portion 102 and the second portion 104 may be fixedly or movably attached to one another using bolts, rivets, welding, an adhesive, or the like. A chain or other fastening element may be utilized to further retain the first portion 102 and the second portion 104 in the first position, where one end of the chain is attached to the first portion 102 and an opposing, second end of the chain is attached to the second portion 104. One example embodiment using a chain to retain the device in the first position is shown in FIG. 4J.

In some example implementations, the first portion 102 is movably attached to the second portion 104 such that the bracket is movable from the first position to a second position (not shown) where the first portion 102 and the second portion 104 are non-perpendicular to one another. For example, the first end of the first portion 102 may be hingedly attached to the first end of the second portion 104, so that the first portion 102 may pivot about the hinge downwards towards the second portion 104. This may result in the bracket being in a collapsed position, which may enable the device 100 to be easily stored when not in use. Alternatively, the first portion may be removable from the second portion for ease of storage. For example, FIG. 2A-L shows an illustration of an embodiment that utilizes conduits to form the first and second portion, and in FIG. 2B these conduits are shown in a disassembled arrangement, potentially for storage.

In use, the device 100 is in the first position, where the second portion 104 is insertable underneath a weighted object 106 (FIG. 1E) so as to restrain the device 100. An opposing second end of the second portion 104 may be pushed underneath the weighted object 106 until an end surface of the weighted object 106 contacts the first portion 102. In various implementations, the weighted object 106 may be a mattress or a couch, or any other object (e.g., a futon) upon which a human user may lay in a supine position. A weight of the weighted object 106, itself, plus a weight of the human user laying on the weighted object 106 may provide enough downward force so as to restrain the device 100 underneath the weighted object 106 when the device 100 is in use.

The device 100 may further comprise a biasing element 108. The biasing element 108 may be a tension spring having a helical shape, although other types of biasing elements may be used in connection with the device 100, including, for example, an elastomeric device, a magnetic device, one or more gears, etc. In various embodiments, any combination of biasing elements is also possible. The biasing element 108 may extend from a first end to an opposing second end, where the first end of the biasing element 108 is mounted toward a first end of the first portion 102 (FIG. 1C) and the second end of the biasing element 108 is arranged at an opposing second end of the first portion 102 (FIG. 1D). The biasing element may have an initial, unextended position (FIG. 1A), and an extended position (FIG. 1E), where force applied to the biasing element 108 causes the biasing element 108 to extend.

The device 100 may further comprise a strap 110 removably attached to the second end of the biasing element 108 and arranged to receive a hinged joint. The strap 110 may comprise looped material, where the material forming the strap forms a closed loop. As such, the hinged joint may be receivable within the looped material of the strap 110. The looped material of the strap 110 may be a nylon, cloth, leather material, or any other type of material that is capable of withstanding a tension force applied thereto. In some example implementations, the strap 110 is clipped to the second end of the biasing element 108 using a carabineer or other type of fastening element. Otherwise, the strap 110 may be joined to the second end of the biasing element 108 in another removable or fixed manner. In some example implementations, it may be advantageous to utilize different straps for different purposes. As such, other straps of varying sizes, shapes, materials, etc., may be utilized with the device 100.

As illustrated in particular in FIG. 1E, the biasing element 108 may apply a tensile force to the hinged joint so as to stretch the hinged joint longitudinally in response to a force exerted by the hinged joint upon receipt thereof in the strap 110. The biasing element 108 applies the tensile force to the hinged joint so as to passively stretch and relieve pressure on connective tissue, membranes, and cartilage of the skeletal structures. In some embodiments, this tensile force is transmitted from the hinged joint to all such joints distally connected. In some embodiments, a distal end of a user may be restrained, potentially via provided under the arms of a user, allowing the tensioning becomes more uniform from the spine to the ankles. In some embodiments, there may be one biasing element 108 and one strap 110 to apply force to only one ankle or two biasing elements 108 and two straps 110 to apply force simultaneously to two ankles. As shown in FIG. 1E, for example, there are two biasing elements 108 and two straps 110.

The device 100 may further comprise a pulley 112 defining a circumference and a central axis, and extending outwardly from the second end of the first portion 102. There may be a single pulley or two pulleys depending on how many biasing elements 108 are utilized by the device 100. As shown in FIG. 1D, there is a single pulley 112 configured to accommodate two biasing elements, although in other implementations there may be two independent pulleys. The pulley 112 may be substantially circular so that the circumference of the pulley 112 is substantially circular. The second end of the biasing element 108 may be movable over the circumference of the pulley 112 into the extended position from the initial position in response to the force exerted by the hinged joint upon receipt thereof in the strap 110. More particularly, upon insertion of the hinged joint in the strap 110 and subsequent force exerted by the hinged joint in the strap 110, the biasing element 108 may elongate into the extended position where the elongated biasing element 108 extends over the circumference of the pulley 112. A distance that the biasing element 108 elongates is determinable by the following formula: $F=-k*x$, where F is the force in Newtons applied to the biasing element 108, k is the spring constant, and x is the distance in meters that the biasing element 108 elongates. It may be advantageous to utilize a biasing element 108 having a less stiff spring (i.e., a lower spring constant) so that less force need be exerted by the ankle in order to move the spring into the extended position.

A support structure 114 may be mounted to the second end of the first portion 102 and extend outwardly therefrom. The support structure 114, in some example implementations, is a structure with a bracket or "C" shape, with a longitudinally-extending lateral member and opposing side members mounted on either longitudinal end of the lateral member. The opposing side members may be mounted to the second end of the first portion 102 so that the pulley 112 is surrounded by the lateral member, the side members, and the second end of the first portion 102. In this manner, the second end of the biasing element 108 may rest against the lateral member of the support structure 114 in the initial position. Further, since the support structure 114 extends outwardly from the second end of the first portion 102, the biasing element 108 in the initial position extends at an angle from the first end of the first portion 102 to the support structure 114 (FIG. 1D).

In some example implementations, the pulley 112 is fixedly mounted to the second end of the first portion 102 and/or the support structure 114 about its central axis. In particular, a bolt may extend through the support structure 114, the second end of the first portion 102, and the central axis of the pulley 112 so that the pulley 112 is fixedly mounted to the support structure 114 and the second end of the first portion 102 (FIG. 1D).

The device 100 may further comprise a restraining element 116 mounted fixedly or movably to the second end of the first portion 102 and extending outwardly therefrom in the same direction as the second portion 104. The restraining element 116, may be formed of the same material or a different material than the bracket. The restraining element 116 may be used to apply a downward force onto the weighted object 106 when the second portion 104 is inserted underneath the weighted object 106. As such, the restraining element 116 may be angled downward so as to apply said force. For example, the restraining element 116 is angled downward at an angle.

FIG. 1B illustrates the restraining element 116 being fixedly mounted to the second end of the first portion 102. However, the restraining element may be adjustable or adjustably mounted along a length of the first portion 102. For example, the restraining element 116 may be mounted (e.g., via adjustable clips) so as to be moved at any point between the first end and the second end of the first portion 102. This may be advantageous, as the restraining element 116 may adjust depending on a height of the weighted object 106. In this way, the second portion 104 and the restraining element 116 act together to "sandwich" the weighted object 106 therebetween (FIG. 1E). Although in the depicted embodiment the restraining element 116 has a width substantially the same as the width as the first portion 102, in other embodiments the restraining element 116 may have a width that is larger than or smaller than the width of the first portion.

FIG. 1G illustrates another example embodiment of the device 100. This embodiment may be useful when attaching the device to a vertical component, such as a bed with a footboard located at one end. The embodiment depicted in FIG. 1G includes a vertical attachment element 130. In the depicted embodiment, vertical attachment element 130 extends from restraining element 116, and in some embodiments, vertical attachment element 130 may secure the device 100 to a vertical component. For example, this embodiment may be used when a user is located on a bed that includes a footboard. The vertical attachment element 130 may be secured to the device to the footboard by various different methods. In some embodiments, the vertical attachment element 130 may hook over one end of the footboard, and in some embodiments, additional fill components (e.g., pillows, wedges, foam, etc.) may be inserted between the footboard and the vertical attachment element 130 to secure the device 100 to the bed via the footboard. In some embodiments, the additional fill components are inserted between the footboard and the first portion 102 to locate the biasing elements 108 and straps 110 distally from the end of the bed, which may allow the device to accommodate taller users. In some embodiments, no fill components are used or needed. Other methods may be used to secure the vertical attachment element 130 to a vertical component. For example, fasteners, straps, additional elastic devices, etc. may be used to secure the vertical attachment element 130 to a vertical component. In addition, in the depicted embodiment, the vertical attachment element 130 extends from restraining element 116. In the depicted embodiment, the vertical attachment element 130 and the restraining element 116 are part of the same structure. In some embodiments, the vertical attachment element 130 extends from other portions of the device, e.g., the first portion 102, the second portion 104, etc. In some embodiments, the vertical attachment element 130 is included in embodiments that do not include restraining elements 116. In some embodiments, the vertical attachment element 130 is removable from the device. In some embodiments, such as the embodiment depicted in FIG. 1G, the device 100 does not include a second portion 102, and instead uses the vertical restraining element 130 to secure the device in a given position/orientation relative to users. In some embodiments, the second portion 104 is movable and can be hinged to vertically align with the first portion 102 when the vertical attachment element 130 is used to secure the device. In some embodiments, the second portion 104 is removable from the device 100.

FIGS. 2A-2L show another illustrative embodiment of the present device. FIG. 2A shows an illustration of this bracket in assembled form, and in this example, one of the biasing elements 1005 is extended for illustrative purposes. In the depicted embodiment, the bracket 1000 may include a first portion 1002, which may include two or more conduits, and a second portion 1001, which may comprise a U-shaped bracket or conduit. In this embodiment, the U-shaped bracket 1001 is configured to be horizontally inserted under a weighted object, such as, for example, a mattress. It is sufficiently dimensioned to extend from under the mattress to accommodate taller individuals. Cushions or wedges may be used to facility this extension at a given desired length. In the depicted embodiment, additional conduits 1002 are connected to the bracket 1001, and in this embodiment, these conduits are connected via a slip fit connection. In the depicted embodiment, the conduits 1002 include an expanded section 1010, which in this embodiment, facilitates the slip fit connection to bracket 1001. The depicted embodiment also includes a cotter pin 1003 inserted along the length of conduit 1002, and in this embodiment, cotter pin 1003 locks in one end of the spring 1005 to the device, which in the depicted embodiment is toward a first end of each of the conduits 1002. Other locations for the cotter pin and/or other mechanism for attaching the spring or elastic member are contemplated within the scope of this disclosure. A clamp 1004 is also included in the depicted embodiment, and in this embodiment, clamp 1004 is used to create a triangulation of the two conduits 1002. Once assembled, the clamp 1004 is bolted tight. Spring 1005 is a coil spring and may serve as the biasing member in this embodiment. Attachment feature 1006 is the releasable loop for coupling the spring 1005 to strap loop 1007, potentially a triangle loop, which holds the fabric or other construction loop 1008, which may serve as the strap in this embodiment.

For conduits 1002 stiffening tubes shaped like an elongated football goalpost may be used. The springs or elastomer cables may be internally mounted and so some friction/resistance will be present.

In this example embodiment the bracket 1001 and the conduits 1002 are fabricated from straight metal electrical conduit (e.g., ½"). Polyethylene may be applied to the internal wall via a process that involves a centrifugal spinning of a loose fitting polyethylene tubing inside a temperature-controlled oven on straight conduit. A properly identified melt temperature should drive/expand the plastic against the wall. As an alternative, a helical cut polyethylene (or other slick polymer tubing like Teflon, polytetrafluoroethylene (PTFE)) that is slightly larger than the internal bore of the conduit may be used. A slight twist decreases the diameter and permits slipping into the conduit. A lining may reduce noise which only occurs when initially mounted.

FIG. 2B shows the components of this bracket in a disassembled configuration in an example embodiment. FIGS. 2C-G show an illustration of how the first portion, the conduits 1002 in the depicted embodiment, may be connected to the second portion, the U-shaped bracket 1001 in the depicted embodiment. FIG. 2C shows the U-shaped bracket 1001 connected to conduits 1002 via a slip fit connection. In some embodiments, conduits 1002 include an enlarged portion 1010 at one end to facilitate this slip fit connection. In some embodiments, U-shaped bracket 1001 includes an enlarged portion at one end to facility this slip fit. FIG. 2D shows a close up of this connection according to an embodiment of this disclosure. FIG. 2E shows these components in an attached configuration. FIG. 2F shows the conduits 1002 attached via clamp 1004 to form a triangulation of the two conduits 1002. FIG. 2G shows a close up for the clamp 1004 connecting the two conduits 1002.

FIGS. 2H and 2I show example embodiments of configurations and methods for connecting the spring 1005 to the device. In these depicted embodiments, a cotter pin 1003 is used to secure one end of the spring 1005 within a conduit 1002, and in the depicted embodiment, each spring 1005 is secured in a similar manner within each conduit 1002. FIG. 2I shows a tool 1020 that may be used to arrange spring 1005 within the conduit 1002 and/or arrange the other end of the spring 1005 through each conduit 1002 and out of an end of each conduit 1002.

FIGS. 2J and 2L show example embodiments of straps 1008 that may be attached to one end of spring(s) 1005. These figures show different illustrations of the attachment features 1006, strap loops 1007, and fabric loops 1008, which forms the strap in some embodiments. In the depicted embodiments these components may detachably connect the strap 1008 to the spring 1005 located within these conduits. These features are located past one end of each conduit 1002.

In another embodiment, an elastomer, e.g., an elastic cord, is used instead of metal for the biasing element. FIGS. 3A-N show example embodiments of this bracket 2000 as well as example components of this device. FIG. 3A shows this embodiment is first position from a top angle. In the depicted embodiment, the first portion 2002 is connected to the second portion 2001. The elastic biasing member 2004 engages with a pulley 2005 within two channels 2003. The elastic biasing member 2004 is attached to attachment features 2006. These attachment features 2006 are connected to strap loops 2007, which are connected to straps 2008. The depicted embodiment also includes extenders 2010 that connect the pulley 2005 to the first portion 2002. In this embodiment, the extenders 2010 include apertures 2011 that allow a bolt 2012 to extend between corresponding apertures 2011 and engage with the extenders 2010 on either side of the first portion 2002. This allows the extenders 2010 to support the bolt 2012 at the apertures 2011, which in turn supports the pulley 2005. The depicted embodiment includes a plurality of corresponding apertures 2011, each of which may support the pulley bolt 2012, allowing a user to adjust the location of the pulley 2005 on the device. The depicted embodiment also includes a protective shield 2013 that may extend over the pulley 2005 and may be used to contain the elastic biasing members 2004 in the appropriate location relative to the device 2000. In the depicted embodiment, the protective shield 2013 is attached to the pulley bolt 2012, and in some embodiments, the protective shield 2013 may pivot about the axis defined by the pulley bolt 2012. FIG. 3B shows an embodiment where the protective shield 2013 is arranged on the top of the pulley 2005. FIG. 3C shows the bracket in a collapsed configuration, and in the depicted embodiment, the first portion 2002 is shorter than the second portion 2001. FIGS. 3D and 3E show illustrations of embodiments that do not include the protective shield 2013. These figures show examples of the device 2000 in the collapsed configuration with the elastic biasing element 2004 and the attached components extending out in various directions.

FIGS. 3F and 3G show illustrations of various components that may be utilized with the depicted embodiments. FIG. 3F shows an embodiment of a pulley 2005 with a pulley rod 2012. FIG. 3G shows an embodiment of a strap 2008 and a strap loop 2007.

FIGS. 3H-3N show illustrations of features that may be used to secure the elastic biasing member 2004 to the bracket. In the depicted embodiment, the first portion 2002 includes two bracket rings 2020. In the depicted embodiment, elastic biasing member 2004 comprise a single elastic cord that extends between each strap 2008. In this embodiment, the elastic biasing member 2004 is secured to the first portion 2002 by looping around a bracket ring 2020. The depicted embodiment also includes rotation rings 2021 which rotate around the bracket ring 2020 and allow the elastic biasing member 2004 to move between the straps 2008 with minimal friction. In the depicted embodiment, two bracket rings 2020 are included, and the elastic biasing member 2004 may be secured to either bracket ring 2020 to adjust the tension of the elastic biasing member and/or the distance the straps extend from the bracket. The depicted embodiment, also includes an enclosure 2025 that may be formed within the first portion 2002 in between a back panel 2026 and a front panel 2027. In the depicted embodiment, the front panel 2027 includes a panel with vertical side walls that form a depth for the front panel 2027. The hollow enclosure 2025 is the space between these side walls formed when front panel 2027 attaches back panel 2026. In the depicted embodiments, the enclosure 2025 may house the bracket ring(s) 2020, and when the enclosure 2025 is formed between the front panel 2027 and the back panel 2026 these panels may secure the elastic biasing member 2004 and the rotation rings 2021 within the enclosure 2025. FIG. 3N shows an illustration of the first portion 2002 with the front panel 2027 and back panel 2026 attached.

As discussed above, in some embodiments the device is collapsible, so that the first portion is movably attached to the second portion such that the bracket is movable from the first position to a second position where the first portion and the second portion are non-perpendicular to one another. FIGS. 4A-F show example second portions 3001, first portions 3002, and hinges 3003, which may be used as part of embodiments that allow the bracket to collapse. FIG. 4J shows an illustration of an embodiment that uses a chain between the first portion and the second portion of the bracket to retain the two in a desired relationship (e.g., 90 degrees) relative to one another. In this embodiment, the chain 3004 attached to the first portion 3001 and the second portion 3002 via bolts 3005. In the depicted embodiment, the chain 3004 secures the first portion 3002 and second portion 3001 in a first position, which in this embodiment is at approximately 90°, which may be beneficial for embodiments that allow the bracket to collapse.

In some embodiments, foam wedges serve to exemplify the extension nature of the device to accommodate taller subjects. The extension can be done with the pair of wedges 4010. FIGS. 5A-B show example illustrations of these embodiments. In some embodiments, a second flap 4020 restrains foam wedges of varying angles so as to accommodate taller subjects by varying the angle of the first portion of the bracket away from the mattress. The second flap 4020 can also be hinged on the back side, which may be fitted with the pulleys and fitted with adjustment brackets to distally move the ankle restraints/tension units, an example of this hinged configuration is shown in FIG. 5C. Unless the sleeper's feet are dramatically sticking out of the bed, the original bracket nests vertically against the mattress without having to place spacing wedges or cushions to move the tensions distally from the mattress. The simplicity of this variant further permits a low profile in a disassembled state and low profile package and the consequent space saving dimensions for transportation.

In some embodiments, the device is usable with a hammock, folding beds, recliners, and the like. It is also contemplated that these configurations can also be designed into exercise equipment for more active participation by the user. It is to be understood that any population group would benefit with relief from sports injuries, or overexerted actions, or ageing members experiencing various aches and pains as a result of the exerting movements and experiences of daily life. The dormant subject could be passively treated under tension in any sleeping (or resting) environment.

In some embodiments, restraints may be used at the head of the bed where the subject is held in place with foam covered brackets that capture the arm pits to apply tension to the entire body. The brackets would similarly be held by the mattress. The subject can pivot them flat away from the arms.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A device for applying a tensile force to a hinged joint, the device comprising:

a bracket having a first portion and a second portion such that the first portion and the second portion are perpendicular to one another in a first position, the second portion is configured to be insertable underneath a weighted object so as to restrain the device, wherein the first portion includes a first stiffened, elongated, tubular conduit and a second stiffened, elongated, tubular conduit, and the second portion is a U-shaped stiffened, elongated, tubular conduit, wherein each of the first conduit and the second conduit has a first end and an opposing second end, and wherein the first end of the first conduit is connected to a first end of the U-shaped conduit through a first slip fit connection and the first end of the second conduit is connected to a second end of the U-shaped conduit through a second slip fit connection;

a first biasing element comprising a first end and an opposing second end, the first biasing element being housed within the first conduit, the first end of the first biasing element being mounted toward the first end of the first conduit and the second end of the first biasing element being arranged at the opposing second end of the first conduit; and a strap removably attached to the second end of the first biasing element and arranged to receive the hinged joint, wherein the first biasing element applies a tensile force to the hinged joint so as to stretch the hinged joint longitudinally in response to a force exerted by the hinged joint upon receipt thereof in the strap, and wherein the first biasing element applies the tensile force to the hinged joint so as to passively stretch and relieve pressure on connective tissue, membranes, and cartilage of the hinged joint.

2. The device of claim 1, wherein the tensile force applied to the hinged joint is transmitted from the hinged joint to at least one joint distally connected to the hinged joint.

3. The device of claim 1, wherein the weighted object is a mattress or a couch.

4. The device of claim 1, wherein the biasing element is a tension spring.

5. The device of claim 1, further comprising a second biasing element, wherein the first biasing element comprises a first tension spring, wherein the second biasing element comprising a second tension spring arranged within the second conduit.

6. The device of claim 1, wherein the at least one of the first conduit and the second conduit includes an inner wall comprising polyethylene.

7. The device of claim 1, wherein the first portion and the second portion form an "L" shape when attached to one another.

8. The device of claim 7, wherein the second portion is insertable underneath the weighted object.

9. The device of claim 1, wherein a length of the first portion is shorter than a length of the second portion.

10. The device of claim 1, wherein the first portion is movably attached to the second portion such that the bracket is movable from the first position to a second position where the first portion and the second portion are non-perpendicular to one another.

11. The device of claim 1, wherein the strap comprises looped material and the hinged joint is receivable within the looped material.

12. The device of claim 1, further comprising a second biasing element and a second strap, the second biasing element being arranged within the second conduit and the second strap is connected to the second biasing element.

13. The device of claim 1, wherein the hinged joint is an ankle.

* * * * *